US012668444B2

(12) United States Patent
Shimohora et al.

(10) Patent No.: US 12,668,444 B2
(45) Date of Patent: Jun. 30, 2026

(54) SHEET CONVEYING DEVICE AND IMAGE FORMING APPARATUS

(71) Applicant: KYOCERA Document Solutions Inc., Osaka (JP)

(72) Inventors: Yuya Shimohora, Osaka (JP); Takehiro Sato, Osaka (JP); Kaori Katsumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/045,669

(22) Filed: Feb. 5, 2025

(65) Prior Publication Data

US 2025/0263259 A1 Aug. 21, 2025

(30) Foreign Application Priority Data

Feb. 15, 2024 (JP) ..... 2024-021007

(51) Int. Cl.
*B65H 5/06* (2006.01)
*B65H 9/00* (2006.01)

(52) U.S. Cl.
CPC ..... *B65H 5/062* (2013.01); *B65H 9/006* (2013.01); *B65H 9/008* (2013.01); *B65H 2404/1316* (2013.01); *B65H 2404/1321* (2013.01); *B65H 2404/1341* (2013.01); *B65H 2404/143* (2013.01); *B65H 2404/1451* (2013.01); *B65H 2404/17* (2013.01); *B65H 2801/06* (2013.01)

(58) Field of Classification Search
CPC ..... B65H 9/006; B65H 9/008; B65H 2404/1316; B65H 2404/1321; B65H 2404/1341; B65H 2404/144; B65H 2404/1451; B65H 2404/17; B65H 2404/143; B65H 5/062; B65H 2402/54; B65H 2404/152
See application file for complete search history.

(56) References Cited

U.S. PATENT DOCUMENTS

| | | | | |
|---|---|---|---|---|
| 7,080,836 | B2 | 7/2006 | Hamada et al. | 271/274 |
| 2004/0262837 | A1 | 12/2004 | Hamada et al. | 271/272 |
| 2007/0069456 | A1* | 3/2007 | Jeong | B65H 9/106 271/274 |
| 2022/0162024 | A1* | 5/2022 | Yang | B65H 3/5215 |
| 2022/0162025 | A1 | 5/2022 | Suzuki | |

FOREIGN PATENT DOCUMENTS

| | | |
|---|---|---|
| JP | 2006-124081 A | 5/2006 |

OTHER PUBLICATIONS

Extended European Search Report dated Jul. 16, 2025, issued to European Application No. 25157102.2.

* cited by examiner

*Primary Examiner* — Jeremy R Severson
(74) *Attorney, Agent, or Firm* — Stein IP, LLC

(57) ABSTRACT

A sheet conveying device includes a first roller, a second roller, and a pressing portion. The pressing portion includes a pressing member contacting the first roller from its side opposite from the second roller and a pressing urging member urging the pressing member toward the second roller. The first roller has a step portion formed in an outer circumferential part of it all over its circumference. The step portion has an outer diameter smaller than the outer diameter of a contact region with the second roller and is contacted by the pressing member.

6 Claims, 6 Drawing Sheets

SHEET CONVEYING DEVICE AND IMAGE FORMING APPARATUS

INCORPORATION BY REFERENCE

This application is based on and claims the benefit of priority from Japanese Patent Application No. 2024-021007 filed on Feb. 15, 2024, the contents of which are hereby incorporated by reference.

BACKGROUND

The present disclosure relates to sheet conveying devices and image forming apparatuses.

Image forming apparatuses such as copiers and printers include a sheet conveying device. The sheet conveying device includes a pair of conveying rollers that conveys sheets. The sheet conveying device conveys sheets one by one from a sheet feeding portion, which stores a stack of sheets as a recording medium to be used for the printing (recording) of images, to an image forming portion (transfer portion), a fixing portion, and a sheet discharge portion.

SUMMARY

According to one aspect of the present disclosure, a sheet conveying device includes a first roller, a second roller, and a pressing portion. The first and second rollers constitute a pair of conveying rollers rotatably disposed opposite each to convey a sheet. The pressing portion, of which at least one is provided, presses the first roller toward the second roller at a position inward of opposite end parts of the rotation shaft of the pair of conveying rollers. The pressing portion has a pressing member that contacts the first roller from its side opposite from the second roller and a pressing urging member that urges the pressing member toward the second roller. The first roller has a step portion that is formed in an outer circumferential part of it all over its circumference. The step portion has an outer diameter smaller than the outer diameter of a contact region with the second roller, and is contacted by the pressing member.

DETAILED DESCRIPTION

An embodiment of the present disclosure will be described below with reference to the accompanying drawings. The following description, however, is not meant to limit the scope of the present disclosure.

Figure 1:
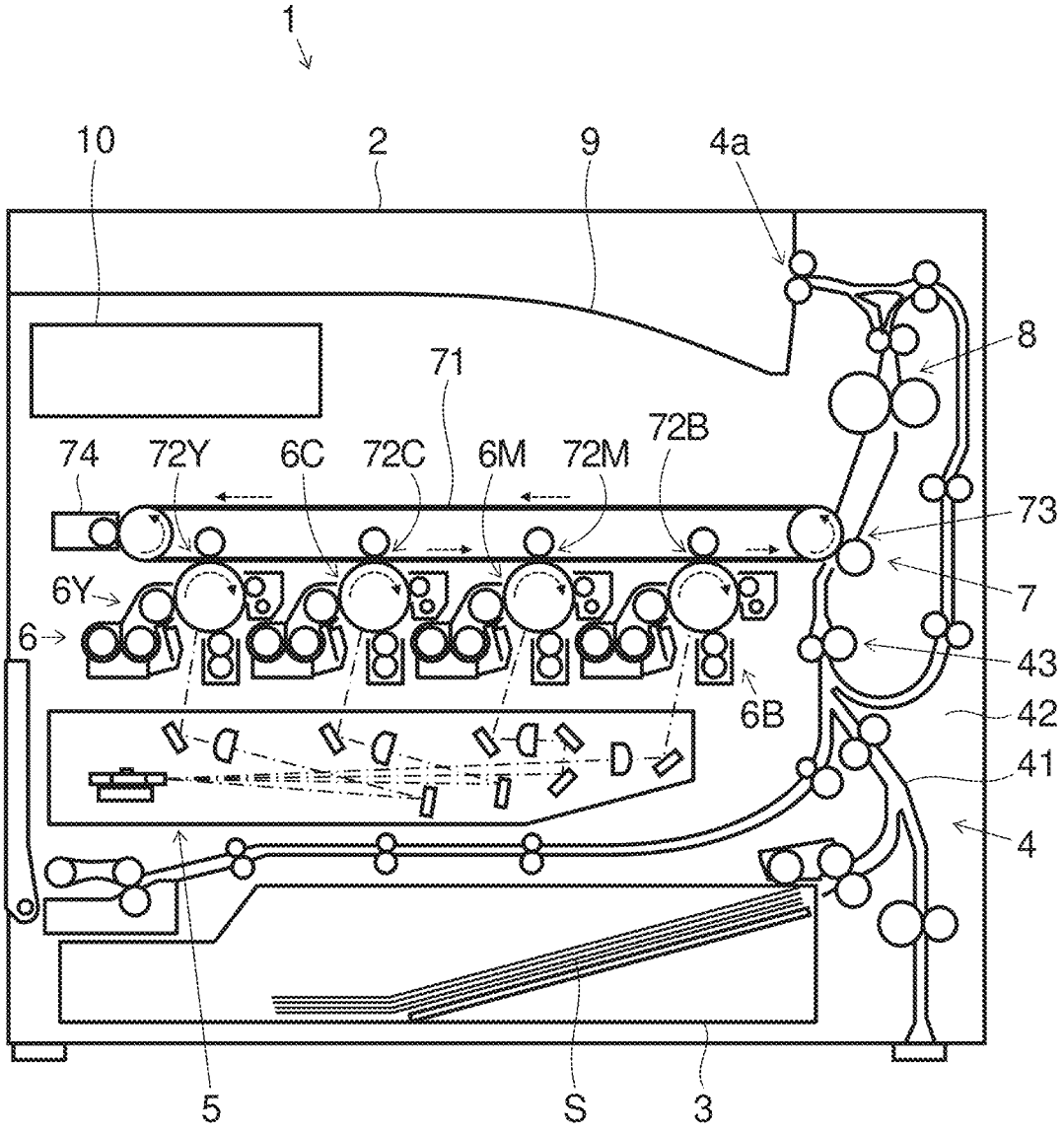
FIG. 1 is a schematic sectional front view of an image forming apparatus according to one embodiment of the present disclosure.

FIG. 1 is a schematic sectional front view of an image forming apparatus 1 according to the embodiment. One example of the image forming apparatus 1 of the embodiment is a tandem-type color printer that transfers a toner image to a sheet S by use of an intermediate transfer belt 71. The image forming apparatus 1 can be what is called a multifunction peripheral that has functions of printing, scanning (image reading), facsimile transmission, and the like.

As shown in FIG. 1, the image forming apparatus 1 includes, inside its body 2, a sheet feeding portion 3, a sheet conveying device 4, an exposure portion 5, an image forming portion 6, a transfer portion 7, a fixing portion 8, a sheet discharge portion 9, and a control portion 10.

The sheet feeding portion 3 is disposed in a bottom part of the body 2. The sheet feeding portion 3 stores a plurality of unprinted sheets S, and separates and feeds out one sheet S after another during printing. The sheet conveying portion 4 extends along a side wall of the body 2, along the top-bottom direction. The sheet conveying portion 4 conveys the sheet S fed out from the sheet feeding portion 3 to a secondary transfer portion 73 and then to the fixing portion 8, and then discharges the sheet S having undergone fixing through a sheet discharge port 4*a* to the sheet discharge portion 9. The exposure portion 5 is disposed above the sheet feeding portion 3. The exposure portion 5 shines laser light controlled based on image data to the image forming portion 6.

The image forming portion 6 is disposed above the exposure portion 5, below the intermediate transfer belt 71. The image forming portion 6 includes an image forming portion 6Y for yellow, an image forming portion 6C for cyan, an image forming portion 6M for magenta, and an image forming portion 6B for black. These four image forming portions 6 have basically the same configuration. Accordingly, in the following description, unless distinction is needed, the suffixes "Y," "C," "M,", and "B" that distinguish colors will sometimes be omitted.

The image forming portion 6 includes a photosensitive drum that is supported so as to be rotatable in a predetermined direction (clockwise in FIG. 1). The image forming portion 6 further includes, disposed around the photosensitive drum along its rotation direction, a charging portion, a developing portion, and a drum cleaning portion. Between the developing portion and the drum cleaning portion, a primary transfer portion 72 is disposed.

The photosensitive drum has a photosensitive layer formed on its outer circumferential surface. The charging portion electrostatically charges the outer circumferential surface of the photosensitive drum to a predetermined surface potential. The exposure portion 5 exposes to light the outer circumferential surface of the photosensitive drum electrostatically charged by the charging portion to form, with attenuated electrostatic charge, an electrostatic latent image of a document image on the outer circumferential surface of the photosensitive drum. The developing portion supplies toner to the electrostatic latent image on the outer circumferential surface of the photosensitive drum to develop it to form a toner image. The four image forming portions 6 form toner images of different colors respectively. The drum cleaning portion performs cleaning by removing the toner and the like that are left on the outer circumferential surface of the photosensitive drum after the primary transfer of the toner images to the outer circumferential surface of the intermediate transfer belt 71. In this way the image forming portion 6 forms the image (toner image) that will later be transferred to the sheet S.

The transfer portion 7 includes the intermediate transfer belt 71, primary transfer portions 72Y, 72C, 72M, and 72B, the secondary transfer portion 73, and a belt cleaning portion 74. The intermediate transfer belt 71 is disposed above the four image forming portions 6. The intermediate transfer belt 71 is an endless intermediate transfer member that is supported so as to be rotatable in a predetermined direction (counter-clockwise in FIG. 1) and to which the toner images formed by the four image forming portions 6 are primarily transferred sequentially so as to be overlaid on each other. The four image forming portions 6 are disposed in what is called a tandem arrangement in which they are arrayed in a row from upstream to downstream in the rotation direction of the intermediate transfer belt 71.

The primary transfer portions 72Y, 72C, 72M, and 72B are disposed, across the intermediate transfer belt 71, above the image forming portions 6Y, 6C, 6M, and 6B of the corresponding colors. The secondary transfer portion 73 is disposed upstream of the fixing portion 8 with respect to the sheet conveyance direction of the sheet conveying portion 4, downstream of the four image forming portions 6Y, 6C, 6M, and 6B with respect to the rotation direction of the intermediate transfer belt 71. The belt cleaning portion 74 is disposed downstream of the secondary transfer portion 73 with respect to the rotation direction of the intermediate transfer belt 71.

The primary transfer portion 72 transfers the toner image formed on the outer circumferential surface of the photosensitive drum to the intermediate transfer belt 71. In other words, the toner images are, in the primary transfer portions 72Y, 72C, 72M, and 72B of the corresponding colors, primarily transferred to the outer circumferential surface of the intermediate transfer belt 71. Then, as the intermediate transfer belt 71 rotates, the toner images from the four image forming portions 6 are transferred, with predetermined timing, to the intermediate transfer belt 71 sequentially so as to be overlaid on each other, so that a color toner image having the toner images of four colors, namely yellow, cyan, magenta, and black, overlaid on each other is formed on the outer circumferential surface of the intermediate transfer belt 71.

The color toner image on the outer circumferential surface of the intermediate transfer belt 71 is transferred, at a secondary transfer nip formed in the secondary transfer portion 73, to a sheet S conveyed by the sheet conveying portion 4 in synchronization. The belt cleaning portion 74 performs cleaning by removing the deposit such as toner that is left on the outer circumferential surface of the intermediate transfer belt 71 after secondary transfer. In this way the transfer portion 7 transfers (records) the toner image formed on the outer circumferential surface of the photosensitive drum to the sheet S.

The fixing portion 8 is disposed above the secondary transfer portion 73. The fixing portion 8 heats and presses the sheet S having the toner image formed on it to fix the toner image to the sheet S.

The sheet discharge portion 9 is disposed above the transfer portion 7. The sheet S having the toner image fixed to it and thus having undergone printing is conveyed to the sheet discharge portion 9. The sheet discharge portion 9 permits the printed sheet (printed matter) to be retrieved upward.

The control portion 10 includes a CPU, an image processor, a storage, and other electronic circuits and electronic components (none is shown). Based on programs and data for control stored in the storage, the CPU controls the operation of the components of the image forming apparatus 1 to perform processes for carrying out the functions of the image forming apparatus 1. The sheet feeding portion 3, the sheet conveying portion 4, the exposure portion 5, the image forming portion 6, the transfer portion 7, and the fixing portion 8 individually receive instructions from the control portion 10 and cooperate to perform printing on the sheet S. The storage is composed of, for example, a combination of a non-volatile storage device (not shown), such as a program ROM (read-only memory) and a data ROM, and a volatile memory device (not shown), such as a RAM (random-access memory).

Figure 2:
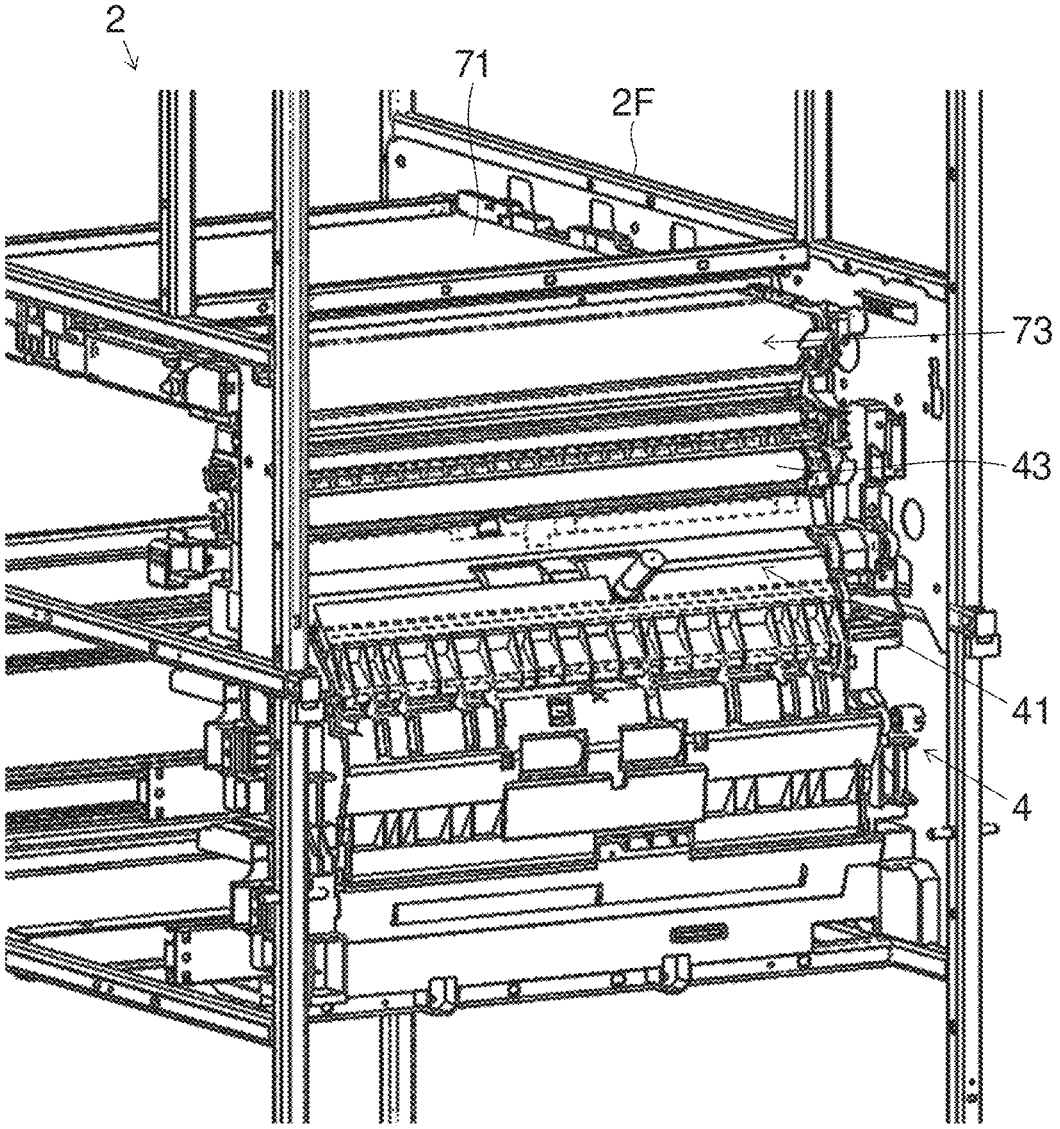
FIG. 2 is a perspective view of a sheet conveying device in the image forming apparatus in FIG. 1.

Next, the construction of the sheet conveying device 4 will be described with reference to FIG. 2 in addition to FIG. 1. FIG. 2 is a perspective view of the sheet conveying device 4 in the image forming apparatus 1 in FIG. 1. Note that FIG. 2 shows only those components that are relevant to the following description. The sheet conveying device 4 includes a sheet conveyance passage 41, an openable/closable portion 42, and a pair of registration rollers 43.

The sheet conveyance passage 41 extends substantially along the top-bottom direction from downstream of the sheet feeding portion 3 in the sheet conveyance direction via the secondary transfer portion 73 and the fixing portion 8 to upstream of the sheet discharge portion 9 in the sheet conveyance direction. The sheet conveyance passage 41 is provided with a plurality of pairs of conveying rollers including the pair of registration rollers 43. The sheet conveyance passage 41, with the plurality of pairs of conveying rollers, conveys the sheet S fed out from the sheet feeding portion 3 to the secondary transfer portion 73 and then to the fixing portion 8, and then discharges the sheet S after fixing through a sheet discharge port 4*a* to the sheet discharge portion 9.

The openable/closable portion 42 extends along a side wall of the body 2, along the top-bottom direction. The openable/closable portion 42 is supported on the body 2 so as to be swingable, with an upper end part of the openable/closable portion 42 as a free end, about a rotation axis disposed in a lower end part of the openable/closable portion 42 and extending in the front-rear direction of the body 2 (along the near-far direction across the plane of FIG. 1). When the upper end part of the openable/closable portion 42 is slanted sideways (rightward in FIG. 1) away from the body 2, the sheet conveyance passage 41 is exposed along with a space around the pair of registration rollers 43. That is, the openable/closable portion 42 is fitted to the body 2 so as to be openable and closable with respect to it.

The pair of registration rollers 43 is disposed upstream of the secondary transfer portion 73 in the sheet conveyance direction. The sheet S fed out from the sheet feeding portion 3 passes through the sheet conveyance passage 41 to reach the pair of registration rollers 43. With the pair of registration rollers 43 the control portion 10 corrects skewed conveyance of the sheet S and feeds out the sheet S toward the secondary nip portion in the secondary transfer portion 73 while adjusting the timing of the conveyance of the sheet S with toner image formation in the image forming portion 6 and primary transfer in the transfer portion 7.

Figure 3:
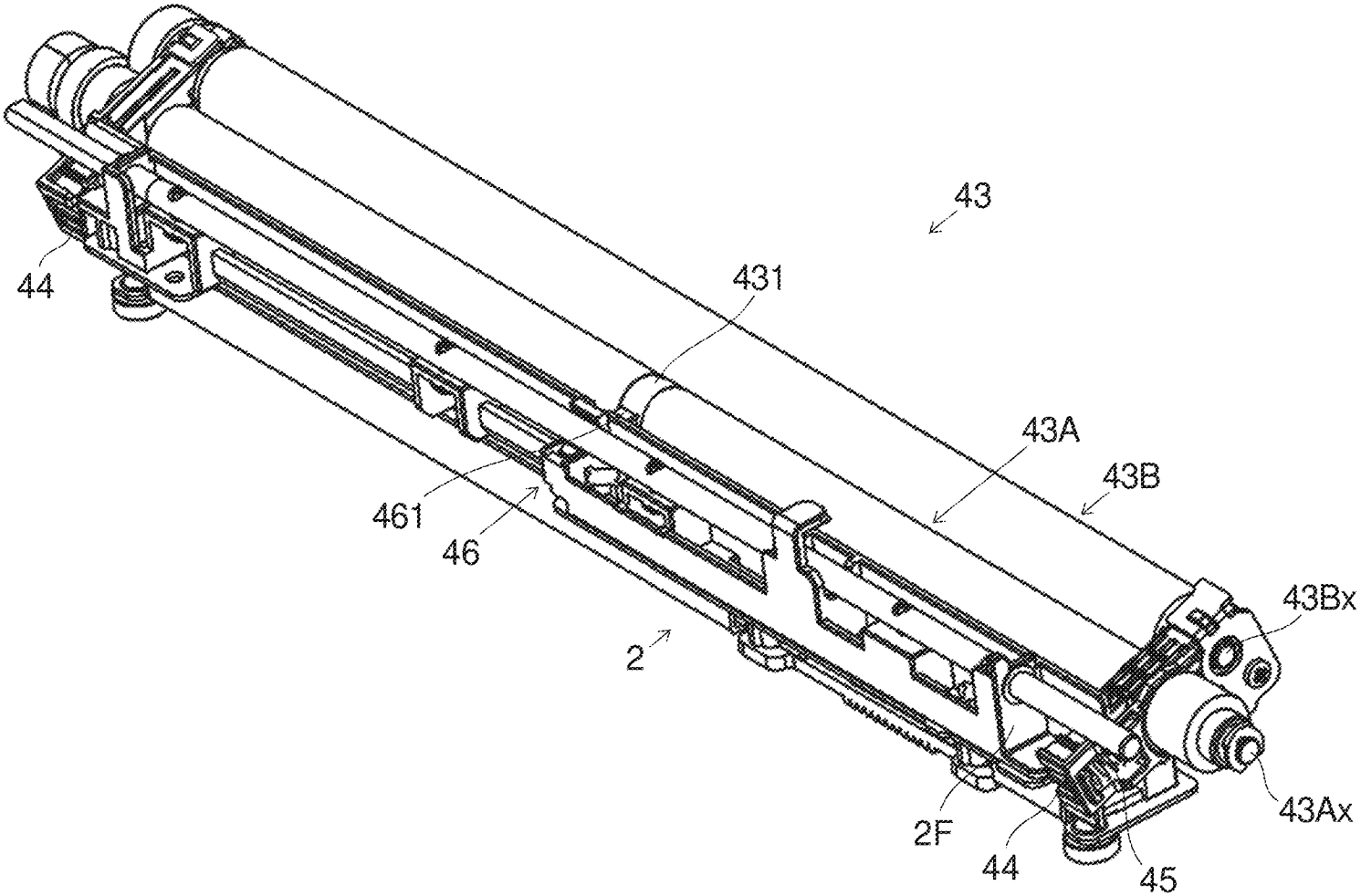
FIG. 3 is a perspective view around a pair of registration rollers in the sheet conveying device in FIG. 2.
Figure 4:
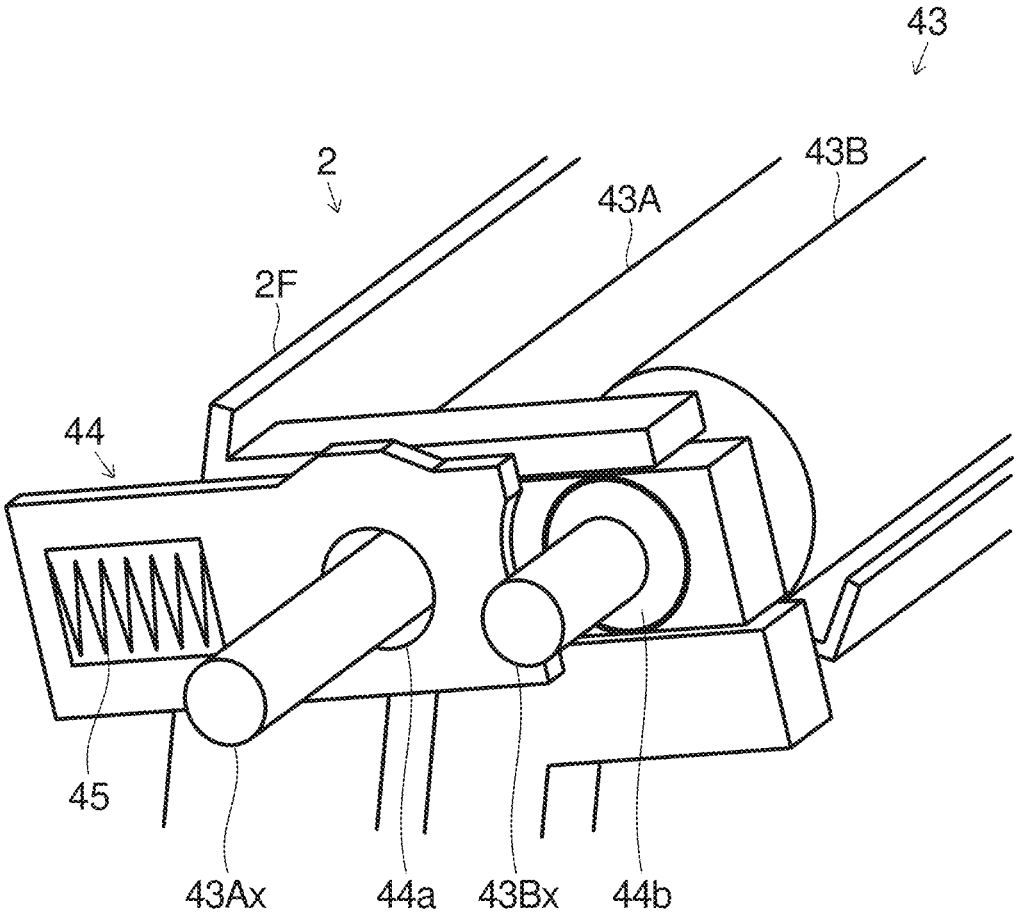
FIG. 4 is a perspective part view around a support portion for the pair of registration rollers in FIG. 3.

Next, the construction around the pair of registration rollers 43 will be described with reference to FIGS. 3 and 4. FIG. 3 is a perspective view around the pair of registration rollers 43 in the sheet conveying device 4 in FIG. 2. FIG. 4 is a perspective part view around a support portion for the pair of registration rollers 43 in FIG. 3. Note that FIG. 4 depicts part of the pair of registration rollers 43 around one end part along its axial direction.

The pair of registration rollers 43 is composed of a first roller 43A and a second roller 43B that together constitute a pair of conveying rollers. The first and second rollers 43A and 43B are disposed opposite each other. The first roller 43A is a driving roller that rotates by being fed with a driving force from a driving motor (not shown). The second roller 43B is a driven roller that rotates by following the first roller 43A by staying in contact with it.

The first roller 43A is rotatably supported on a body frame 2F of the body 2. Specifically, the rotation shaft 43Ax of the first roller 43A is rotatably supported via a bearing (not shown) fitted to the body frame 2F. At each end part of the pair of registration rollers 43 along its axial direction, a bush member 44 and a counter-urging member 45 are disposed.

The bush member 44 is disposed at each end part of the pair of registration rollers 43 along its axial direction. The bush member 44 is formed substantially in the shape of a rectangular parallelepiped extending along the direction along which the first and second rollers 43A and 43B face each other, and is supported on the body frame 2F so as to be movable along the axial direction of the first roller 43A. The bush member 44 has a hole 44*a* and a bearing 44*b*.

The hole 44*a* is disposed at the position where the rotation shaft 43Ax of the first roller 43A is located, and penetrates the bush member 44 along the axial direction of the rotation shaft 43Ax. The hole 44*a* is formed substantially in a cylindrical shape, and is penetrated by the rotation shaft 43Ax. Within the movement range of the bush member 44, which is movable along the radial direction of the first roller 43A, the rotation shaft 43Ax does not contact an inner circumferential part of the hole 44*a*.

The bearing 44*b* is disposed at the position where the rotation shaft 43Bx of the second roller 43B is located. The bearing 44*b* is fixed to the bush member 44, and rotatably supports the rotation shaft 43Bx. In other words, the bush member 44 rotatably supports the second roller 43B. That is, the second roller 43B is supported on the body 2 via the bush member 44. As the bush member 44, which is movable along the radial direction of the first roller 43A, moves, the second roller 43B moves along the radial direction of the first roller 43A.

The counter-urging member 45 is disposed adjacent to the bush member 44, at the side opposite from the second roller 43B across the first roller 43A. The counter-urging member 45 is configured with, for example, a compression coil spring that is disposed so as to expand and compress along the radial direction of the first roller 43A. The counter-urging member 45 is, at one end in its expansion-compression direction, supported on the body frame 2F and, at the other end, supported on the bush member 44.

The counter-urging member 45 urges the bush member 44, which is movable along the radial direction of the first roller 43A, relative to the body frame 2F. Specifically, the counter-urging member 45 urges the bush member 44 in such a direction that the second roller 43B comes closer to the first roller 43A, that is, leftward in FIG. 4.

Owing to the above-described supporting mechanism for the first and second rollers 43A and 43B, the pair of registration rollers 43 has its first and second rollers 43A and 43B both supported on the body 2. This allows accurate positioning and stable pressing.

Figure 5:
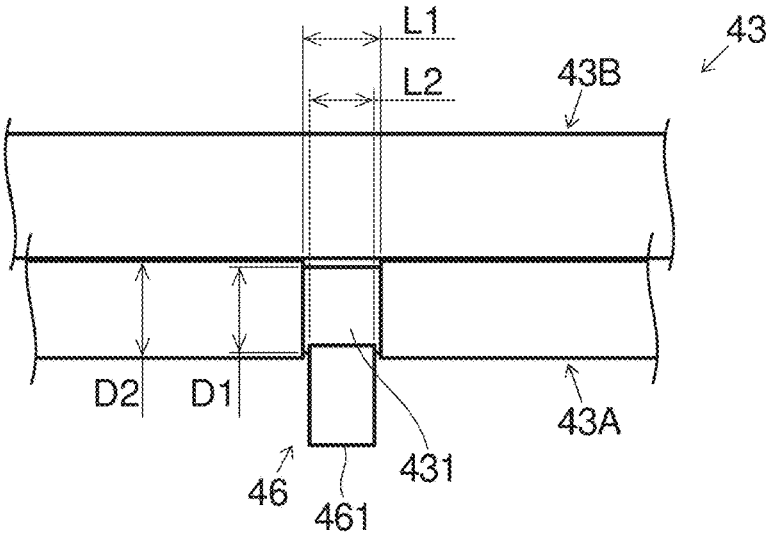
FIG. 5 is a schematic top view around the pair of registration rollers in FIG. 3, in a middle part of it along the axial direction.
Figure 6:
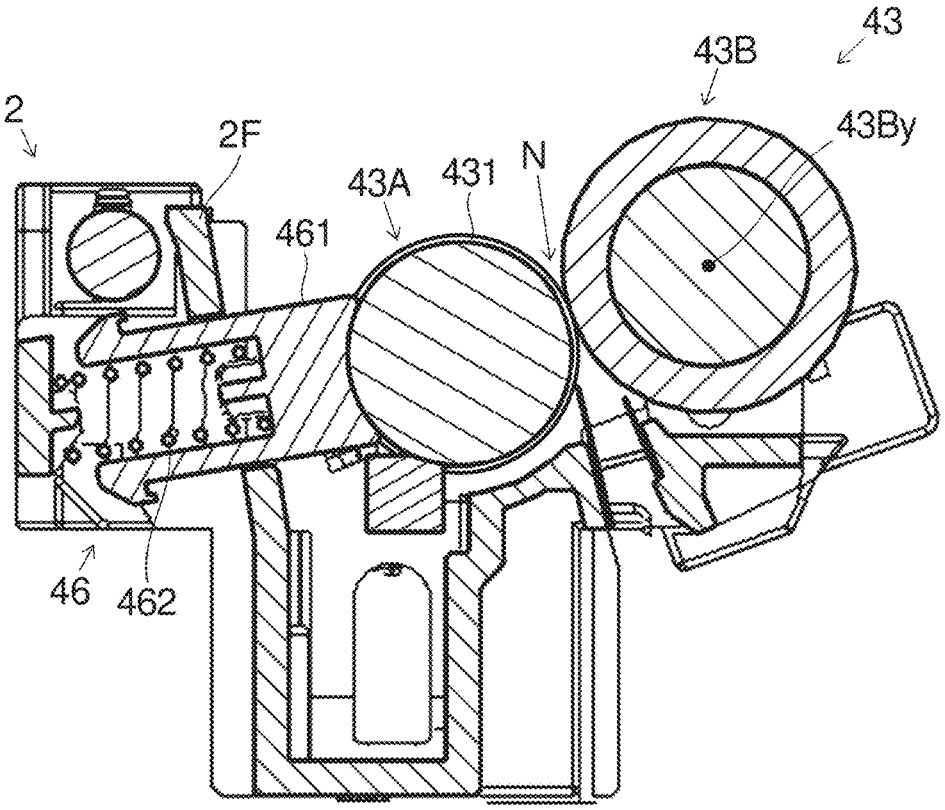
FIG. 6 is a sectional front view around the pair of registration rollers in FIG. 3, in a middle part of it along the axial direction.
Figure 7:
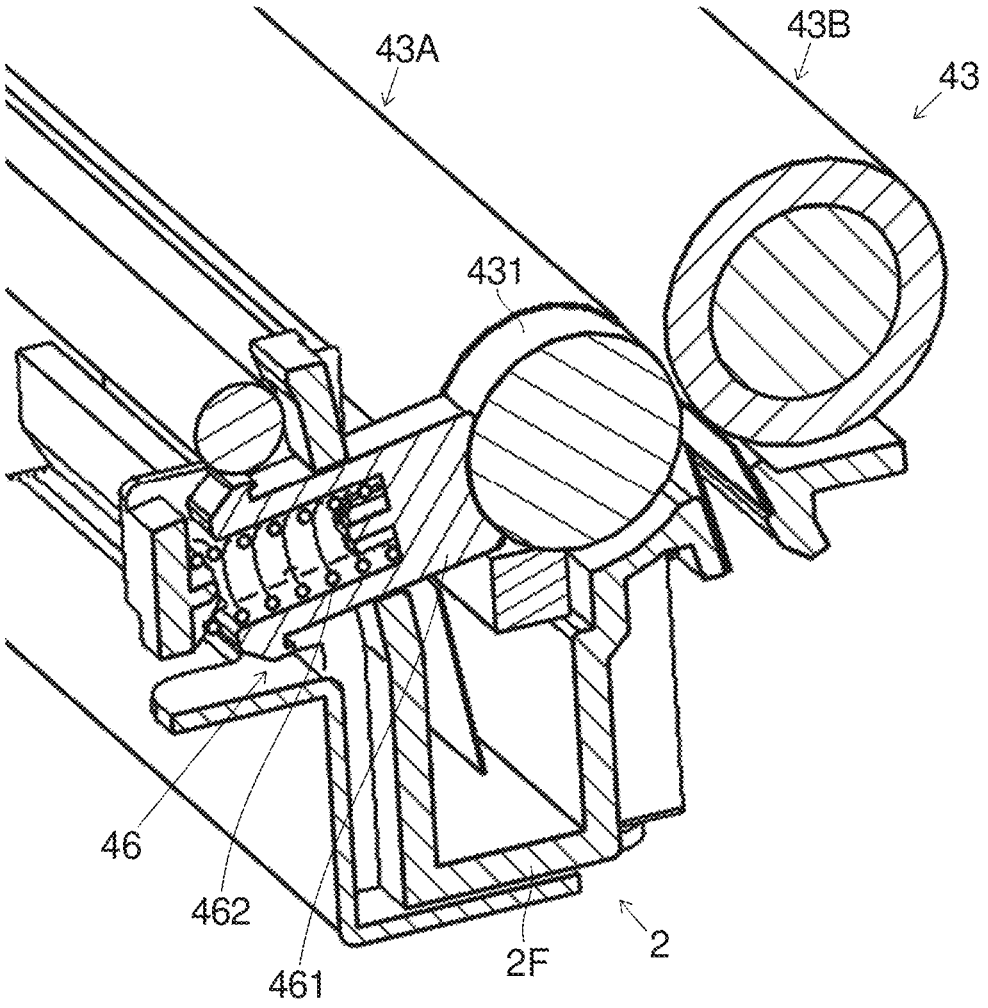
FIG. 7 is a sectional perspective view around the pair of registration rollers in FIG. 3, in a middle part of it along the axial direction.

The construction around the pair of registration rollers 43 will now be described in more detail with reference to, in addition to FIG. 3, FIGS. 5 to 7. FIGS. 5, 6, and 7 are a schematic top view, a sectional front view, and a sectional perspective view, respectively, around the pair of registration rollers 43 in FIG. 3, in a middle part of it in the axial direction. The sheet conveying device 4 further includes a pressing portion 46.

The pressing portion 46 is disposed inward of the opposite ends of the pair of registration rollers 43 along the axial direction. Specifically, in the embodiment, the pressing portion 46 is disposed at one place at the middle of the pair of registration rollers 43 along the axial direction. One or more pressing portions 46 can be provided; that is, a plurality of them can be provided. The pressing portion 46 has a pressing member 461 and a pressing urging member 462. The first roller 43A has a step portion 431 disposed opposite the pressing portion 46.

The pressing member 461 is disposed at the side opposite from the second roller 43B across the first roller 43A. The pressing member 461 contacts the first roller 43A from the side opposite from the second roller 43B. A tip end part of the pressing member 461, which faces the first roller 43A, is formed in the shape of a rectangular parallelepiped. The tip end face of the pressing member 461 contacting the first roller 43A is a curved face that fits the circumferential face of the step portion 431 of the first roller 43A.

The pressing urging member 462 is disposed adjacent to the pressing member 461, at the side opposite from the second roller 43B across the first roller 43A. The pressing urging member 462 is configured with, for example, a compression coil spring that is disposed so as to expand and contract along the radial direction of the first roller 43A. The pressing urging member 462 is, at one end along its expansion-compression direction, supported on the body frame 2F and, at the other end, on the pressing member 461.

The pressing urging member 462 urges the pressing member 461, which is movable along the radial direction of the first roller 43A, relative to the body frame 2F. That is, the pressing urging member 462 urges the pressing member 461 toward the second roller 43B. Specifically, the pressing urging member 462 urges the pressing member 461 in such a direction that the first roller 43A comes closer to the second roller 43B, that is, rightward in FIG. 6.

The step portion 431 is disposed opposite the pressing member 461 such that the pressing member 461 contacts it. The outer diameter D1 of the step portion 431 is smaller than the outer diameter D2 of the contact region between the first and second rollers 43A and 43B. The step portion 431 is formed in an outer circumferential part of the first roller 43A, all around its circumference. The step portion 431 is formed in the shape of a cylinder of which the center axis coincides with the contact region between the first and second rollers 43A and 43B.

The dimension L1 of the step portion 431 along the axial direction is larger than the dimension L2 of the pressing member 461 along the axial direction. The pressing member 461 contacts the first roller 43A in an inward region of the step portion 431 along the axial direction.

With the above construction, at the place on the step portion 431 against which the pressing member 461 is pressed, the first roller 43A does not contact the second roller 43B. This helps suppress a rise in the pressure between the first and second rollers 43A and 43B at the place against which the pressing member 461 is pressed. It is thus possible to suppress misalignment and sagging of the pair of registration rollers 43 and to suppress creases in the sheet S conveyed.

The pressing portion 46 is disposed at one place at the middle along the axial direction of the pair of registration rollers 43. This makes it possible to raise the pressure between the first and second rollers 43A and 43B uniformly from one to the other end of the pair of registration rollers 43 along the axial direction. This helps enhance the effect of suppressing misalignment and sagging of the pair of registration rollers 43.

Specifically, with the pressing urging member 462 the pressing portion 46 urges the pressing member 461 upstream in the sheet conveyance direction with respect to the center axis 43By of the second roller 43B, that is, downward relative to the center axis 43By in FIG. 6. In other words, with the pressing urging member 462 the pressing portion 46 urges the pressing member 461 upstream of the nip portion N in the pair of registration rollers 43 in the sheet conveyance direction, that is, downward relative to the nip portion N in FIG. 6.

With the above construction, the urging force of the pressing urging member 462 acts on the first roller 43A as the driving roller in a part of it upstream of the nip portion N in the rotation direction. This helps increase the gripping force on the sheet S entering the nip portion N and hence enhance the capability of the first roller 43A to convey the sheet S. It is thus possible to enhance the conveying performance of the pair of registration rollers 43 with the sheet S.

Urging the pressing member 461 upstream in the sheet conveyance direction with respect to the center axis 43By of the second roller 43B as the driven roller as described above is considered to make it easy for the second roller 43B to move downstream in the sheet conveyance direction. However, the movement of the second roller 43B downward in the sheet conveyance direction can be prevented by the above-described supporting mechanism at the opposite end parts of each of the first and second rollers 43A and 43B along the axial direction.

In the above construction, the pressing portion 46 is provided opposite the first roller 43A as the driving roller with respect to the second roller 43B as the driven roller. It is thus possible to suppress misalignment and sagging of the first and second rollers 43A and 43B and creases in the sheet S conveyed and meanwhile enhance the conveying performance of the pair of registration rollers 43 with the sheet S.

In addition, in the above construction, the pair of registration rollers 43 is provided with the pressing portion 46. It is thus possible to suppress, for the pair of registration rollers 43, misalignment and sagging of the pairs of rollers and creases in the sheet S conveyed, and furthermore to correct skewed conveyance of the sheet S and enhance the performance related to adjustment of the timing of conveyance of the sheet S.

The embodiment of the present disclosure described above is not meant to limit the scope of the present disclosure, which can thus be implemented with any modifications made without departure from the spirit of the present disclosure.

What is claimed is:

1. A sheet conveying device comprising:

a first roller and a second roller that constitute a pair of conveying rollers rotatably disposed opposite each to convey a sheet; and at least one pressing portion that presses the first roller toward the second roller at a position inward of opposite end parts of the pair of conveying rollers along an axial direction, wherein the pressing portion includes:

a pressing member that contacts the first roller from a side thereof opposite from the second roller;

a pressing urging member that urges the pressing member toward the second roller, and the first roller has a step portion that is formed in an outer circumferential part of the first roller all over a circumference thereof, the step portion having an outer diameter smaller than an outer diameter of a contact region with the second roller, the step portion being contacted by the pressing member, the first roller is rotatably supported on a body frame of an apparatus body, and the sheet conveying device further comprises:

a bush member that is supported on the body frame so as to be movable along a radial direction of the first roller, the bush member rotatably supporting the second roller; and a counter-urging member that urges the bush member in such a direction that the second roller comes closer to the first roller.

2. The sheet conveying device according to claim 1, wherein the pressing portion is disposed at a middle of the pair of conveying rollers along the axial direction.

3. The sheet conveying device according to claim 1, wherein with the pressing urging member the pressing portion urges the pressing member upstream of a center axis of the second roller in a sheet conveyance direction.

4. The sheet conveying device according to claim 1, wherein the first roller is a driving roller that rotates by being fed with a driving force, and the second roller is a driven roller that rotates by following the first roller by staying in contact with the first roller.

5. An image forming apparatus comprising the sheet conveying device according to claim 1.

6. The image forming apparatus according to claim 5, wherein the pair of conveying rollers is a pair of registration rollers that conveys the sheet while correcting skewed conveyance of the sheet.

* * * * *